US012114796B2

(12) United States Patent
Farias

(10) Patent No.: US 12,114,796 B2
(45) Date of Patent: Oct. 15, 2024

(54) CURTAIN RESTRAINT ASSEMBLY

(71) Applicant: Robert Farias, Aledo, TX (US)

(72) Inventor: Robert Farias, Aledo, TX (US)

( * ) Notice: Subject to any disclaimer, the term of this patent is extended or adjusted under 35 U.S.C. 154(b) by 111 days.

(21) Appl. No.: 18/082,335

(22) Filed: Dec. 15, 2022

(65) Prior Publication Data

US 2024/0197098 A1 Jun. 20, 2024

(51) Int. Cl.
*A47H 1/02* (2006.01)

(52) U.S. Cl.
CPC ..... *A47H 1/02* (2013.01)

(58) Field of Classification Search
CPC ..... A47H 1/02
USPC ..... 4/558
See application file for complete search history.

(56) References Cited

U.S. PATENT DOCUMENTS

| | | | | |
|---|---|---|---|---|
| 2,107,421 | A * | 2/1938 | Lennox | A47H 21/00 206/231 |
| 2,293,883 | A * | 8/1942 | Bossert | A47H 19/00 160/349.2 |
| 4,361,914 | A | 12/1982 | Oliver | |
| 4,569,108 | A * | 2/1986 | Schwab | F16B 45/00 24/17 AP |
| 5,345,623 | A * | 9/1994 | Dearman | A47K 3/38 4/558 |
| D380,585 | S | 7/1997 | Olson | |
| 5,809,589 | A | 9/1998 | Johnson | |
| 6,845,525 | B2 | 1/2005 | Bathurst | |
| 2009/0293191 | A1 | 12/2009 | Koyzan | |
| 2018/0344099 | A1 | 12/2018 | Gross | |
| 2023/0142478 | A1 * | 5/2023 | Watson | A47K 3/38 4/558 |

FOREIGN PATENT DOCUMENTS

| | | |
|---|---|---|
| WO | WO2004023958 | 3/2004 |

OTHER PUBLICATIONS

Magnetic Curtain Tieback Amazon.com dated Nov. 17, 2020; printed May 31, 2024 (Year: 2020).*
Amazon.com Magnetic Curtain Tie. (Year: 2020).*

* cited by examiner

*Primary Examiner* — Christine J Skubinna

(57) ABSTRACT

A curtain restraint assembly includes a shower stall that has a pair of opposing walls and a shower curtain suspended in an entry of the shower stall. A pair of hooks is each attachable to a respective one of the opposing walls of the shower stall. A pair of cords includes a key ring which can be hooked on a respective one of the hooks for movably retaining the pair of cords on the respective hooks. Each of pair of cords is extendable across the shower curtain thereby inhibiting the shower curtain from blowing into the shower stall. A pair of mating units is each attached to a respective one of the pair of cords. The pair of mating units is releasably matable to each other to attach the cords to each other.

8 Claims, 4 Drawing Sheets

CURTAIN RESTRAINT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to restraint devices and more particularly pertains to a new restraint device for inhibiting a shower curtain from blowing into a shower stall. The device includes a pair of hooks that are each attached to a respective opposing wall of the shower stall. The device includes a pair of cords that is each suspended from a respective one of the hooks. The device includes a pair of mating members that is each attachable together to facilitate the cords to extend across the shower curtain thereby inhibiting the shower curtain from blowing into the shower stall.

(2) Description of Related Art Including Information Disclosed Under 37 CFR 1.97 and 1.98

The prior art relates to restraint devices including a curtain holder that includes a pair of hooks, a pair of rings being positioned around a respective hook and a cord being looped through each of the rings to the cord to wrap around a curtain. The prior art discloses a curtain restraint that includes a cord and a pair of couplers attached to respective ends of the cord thereby facilitating the couplers to be attached to respective surfaces of a shower stall having the cord extending across a shower curtain. The prior art discloses a shower curtain cord that includes a turnbuckle and a biasing member each attached to a respective opposing wall of a shower stall. The prior art discloses a shower expander that includes a cord attached to a wall of a shower stall and which is extendable through a shower curtain for pulling the shower curtain away from a person bathing. The prior art discloses a retractor attached to a wall of a shower stall and a cord that can be pulled outwardly from the retractor. The prior art discloses a shower curtain restraint that includes a plurality of curved members that are vertically oriented between a curtain rod and a tub surround.

BRIEF SUMMARY OF THE INVENTION

An embodiment of the disclosure meets the needs presented above by generally comprising a shower stall that has a pair of opposing walls and a shower curtain suspended in an entry of the shower stall. A pair of hooks is each attachable to a respective one of the opposing walls of the shower stall. A pair of cords includes a key ring which can be hooked on a respective one of the hooks for movably retaining the pair of cords on the respective hooks. Each of pair of cords is extendable across the shower curtain thereby inhibiting the shower curtain from blowing into the shower stall. A pair of mating units is each attached to a respective one of the pair of cords. The pair of mating units is releasably matable to each other to attach the cords to each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
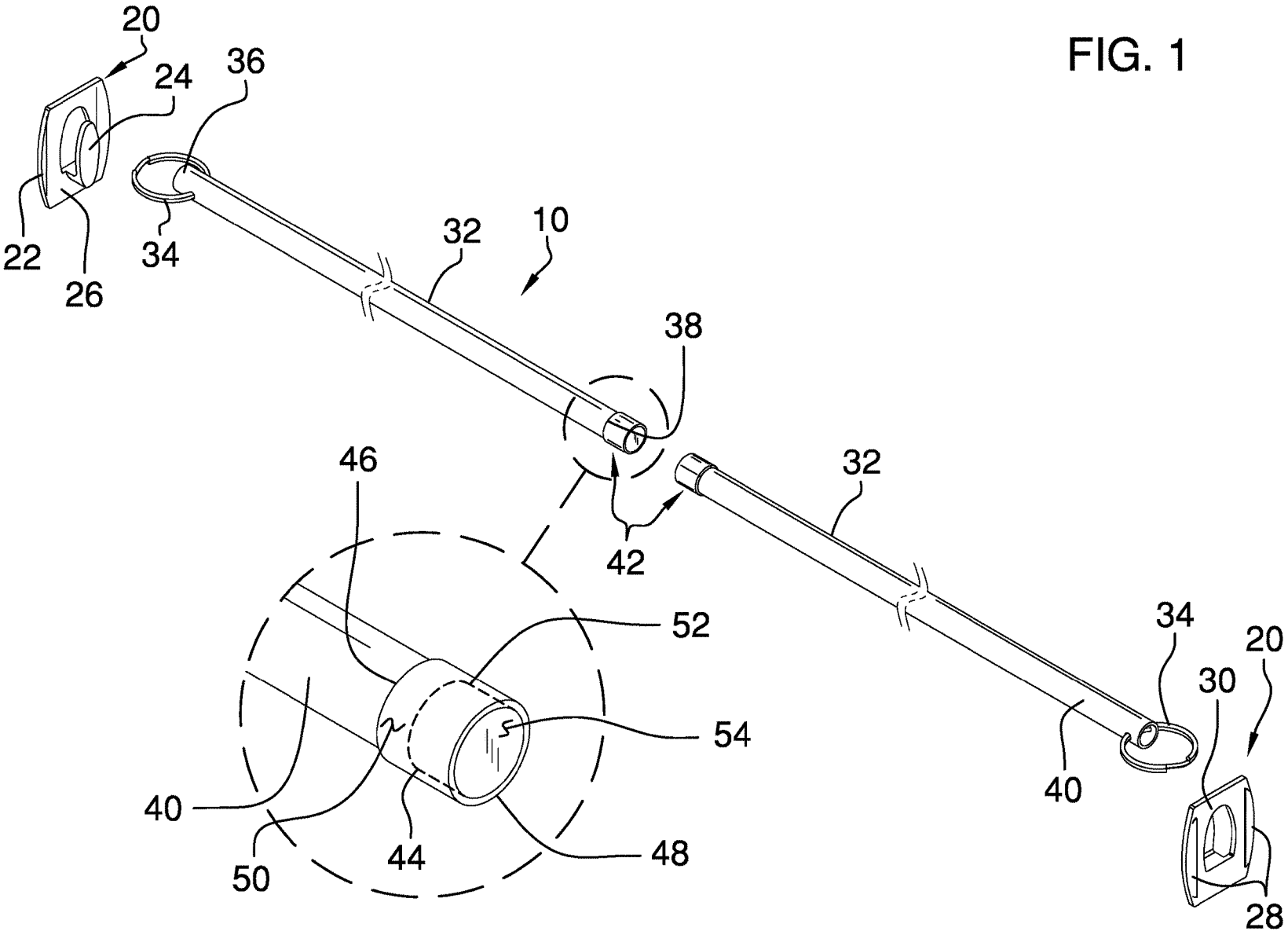
FIG. 1 is a perspective view of a curtain restraint assembly according to an embodiment of the disclosure.
Figure 2:
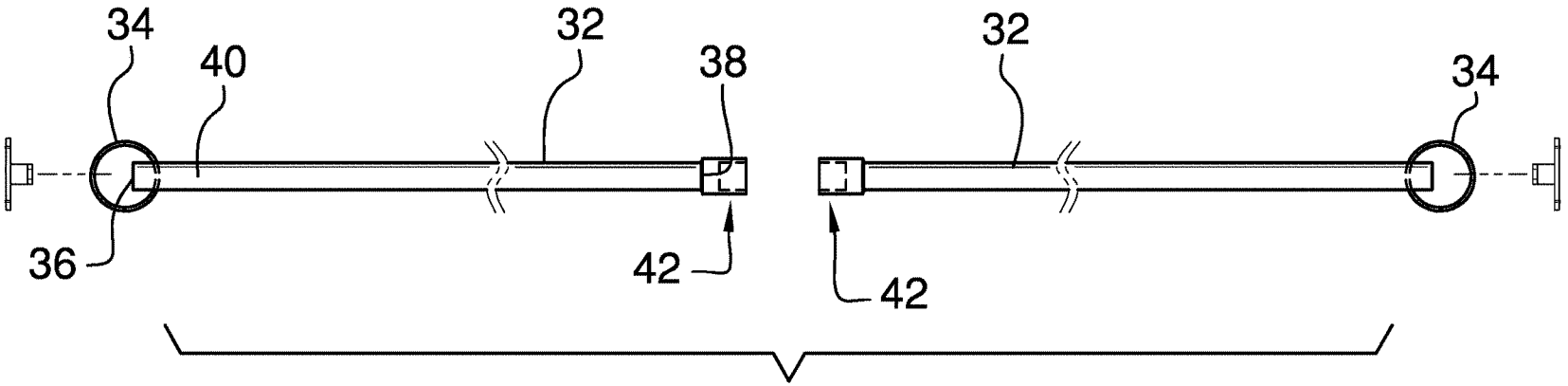
FIG. 2 is a front view of an embodiment of the disclosure.
Figure 3:
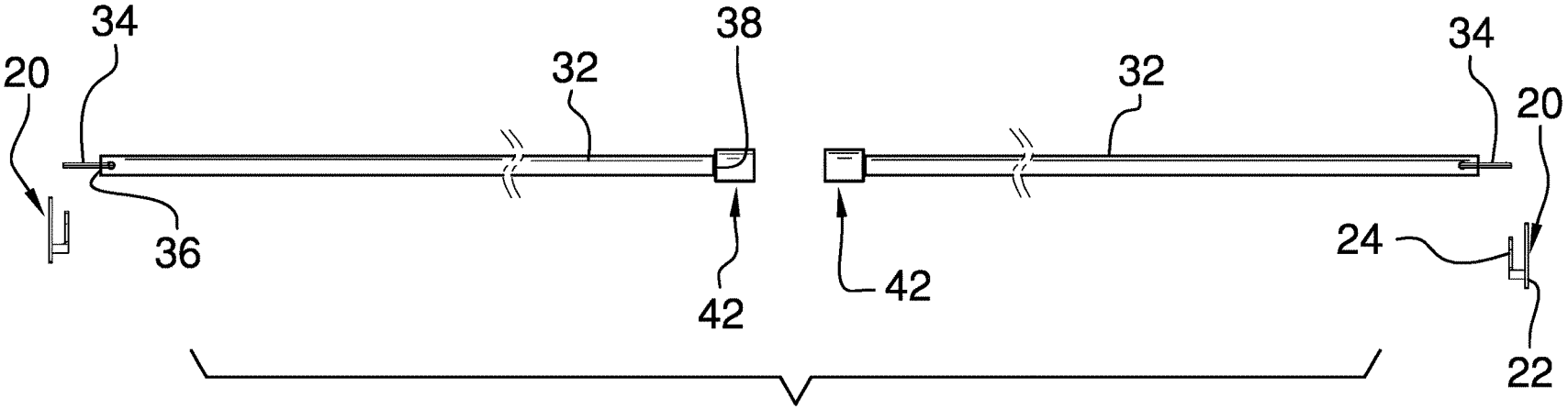
FIG. 3 is a top view of an embodiment of the disclosure.
Figure 4:
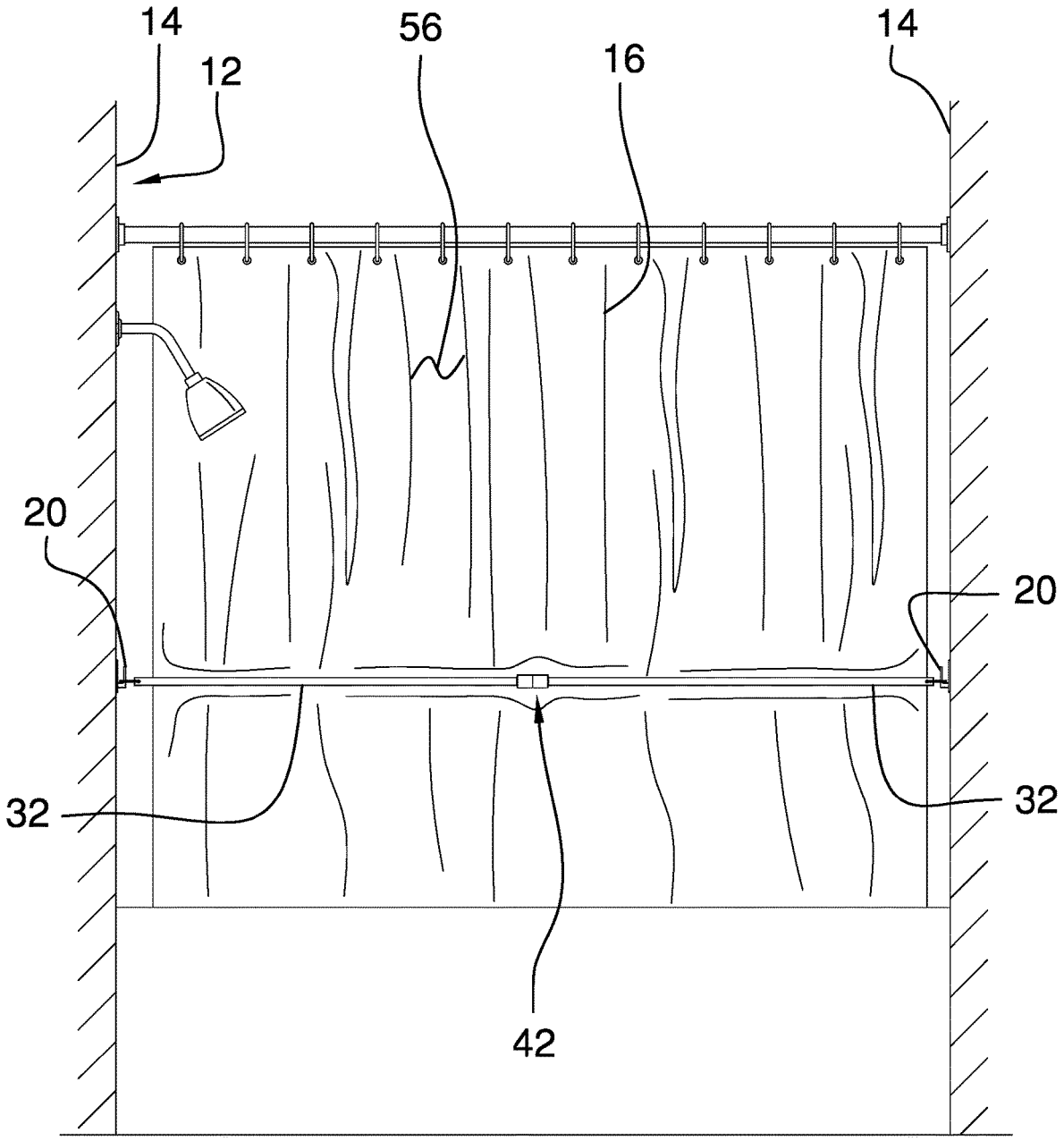
FIG. 4 is a perspective in-use view of an embodiment of the disclosure showing a pair of cords in a deployed position.
Figure 5:
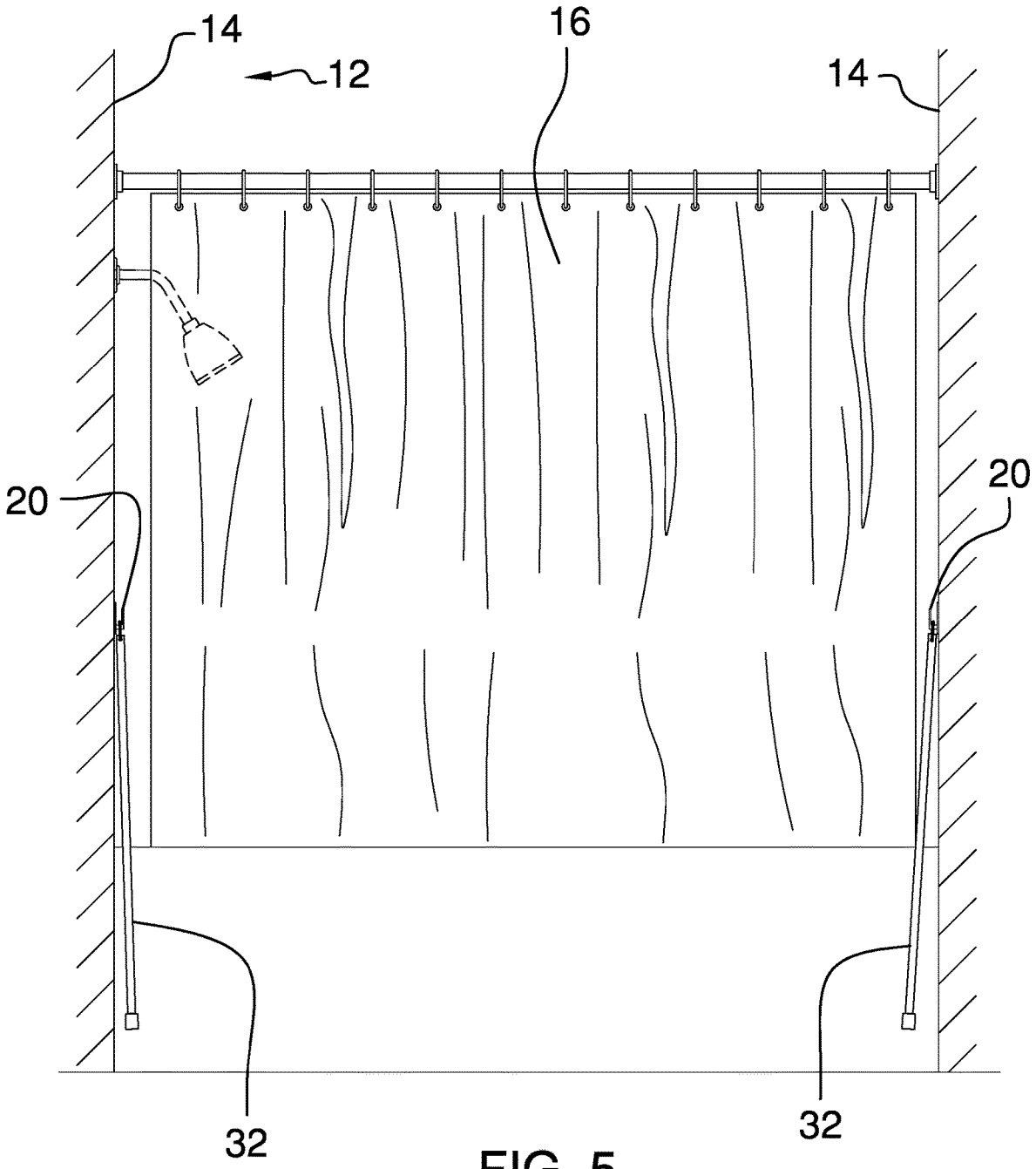
FIG. 5 is a perspective in-use view of an embodiment of the disclosure showing a pair of cords is a stored position.

With reference now to the drawings, and in particular to FIGS. 1 through 5 thereof, a new restraint device embodying the principles and concepts of an embodiment of the disclosure and generally designated by the reference numeral 10 will be described.

As best illustrated in FIGS. 1 through 5, the curtain restraint assembly 10 generally comprises a shower stall 12 that has a pair of opposing walls 14. The shower stall 12 may be a tub/shower combo fixture, a walk in shower or any other conventional type of shower for bathing. A shower curtain 16 is suspended in an entry 18 of the shower stall 12 and the shower curtain 16 extends between the pair of opposing walls 14 when the shower curtain 16 is in a closed position.

The shower curtain 16 may be a shower curtain of any conventional design that would commonly be found in showers for bathing.

A pair of hooks 20 is provided and each of the hooks 20 is attachable to a respective one of the opposing walls 14 of the shower stall 12. Each of the hooks 20 comprises a panel 22 and a member 24 curving upwardly from a front side 26 of the panel 22. A substantial length of the member 24 is spaced from and is oriented parallel to the front side 26. Each of the hooks 20 includes a mating element 28 that is applied to a back side 30 of the panel 22 thereby facilitating the mating element 28 to engage the respective opposing wall 14 for retaining the panel 22 on the respective opposing wall 14. The mating element 28 associated with each of the hooks 20 may comprise an adhesive pad, a liquid glue applied to the back side of the panel 22 or any other type of mating element that is capable of engaging a vertical surface in manner that is unaffected by water.

A pair of cords 32 is provided and each of the cords 32 has a key ring 34 which can be hooked on a respective one of the hooks 20 for movably retaining the pair of cords 32 on the respective hooks 20. Each of pair of cords 32 is positionable in a deployed position having the pair of cords 32 extending across the shower curtain 16. In this way the shower curtain 16 is inhibited from blowing into the shower stall 12. Thus, the pair of cords 32 inhibits the shower curtain 16 from touching a person bathing in the shower stall 12. Each of the cords 32 is positionable in a stored position having the cords 32 hanging from the respective hook 20.

Each of the cords 32 has a first end 36 and a second end 38 and the key ring 34 on each of the cords 32 extends through an outer wall 40 of a respective cord 32 at a point located adjacent to the first end 36 of the respective cord 32. Furthermore, the key ring 34 on each of the cords 32 extends around the member 24 associated with the respective hook 20 for suspending the cords 32 on the hooks 20. Each of the pair of cords 32 is comprised of a flexible and fluid impermeable material, including but not being limited to rubber or silicone, thereby inhibiting the pair of cords 32 from is affected by water. The key ring 34 on each of the cords 32 may be comprised of a corrosion resistant material, including but not being limited to stainless steel or plastic, thereby inhibiting the ring from rusting.

A pair of mating units 42 is provided and each of the mating units 42 is attached to a respective one of the pair of cords 32. The pair of mating units 42 is releasably matable to each other thereby facilitating the cords 32 to be attached each other for retaining the cords 32 in the deployed position. Each of the pair of mating units 42 comprises a cup 44 that has a rear end 46 and a front end 48. The rear end 46 of each of the pair of cups 44 is attached to the second end 38 of a respective one of the cords 32 and the front end 48 of each of the cups 44 is open. Additionally, each of the cups 44 has an outside diameter that is greater than a diameter of the respective cord 32 such that an outer surface 50 of the pair of cups 44 is displaced outwardly from the outer wall 40 of the respective cord 32.

Each of the mating units 42 includes a magnet 52 that is positioned within the cup 44. The magnet 52 has a forward surface 54 which is aligned with the front end 48 of the respective cup 44. Furthermore, the forward surface 54 of the magnet 52 in the cup 44 associated with each of the mating units 42 is magnetically matable to each other. In this way the mating units 42 facilitate the pair of cords 32 to be mated together. Additionally, the magnet 52 associated with each of the mating units 42 may comprise a natural earth magnet that is corrosion resistant.

In use, the mating element 28 associated with each of the hooks 20 is mated to the respective opposing wall 14 of the shower stall 12 such that each of the hooks 20 is aligned with the shower curtain 16. The key ring 34 on each of the cords 32 is placed around the member 24 of the respective hook 20 for suspending the cords 32 on the respective hooks 20. As is most clearly shown in FIG. 4, the cords 32 are extended across an inwardly facing side 56 of the shower curtain 16 and the mating units 42 are mated to each other. In this way the cords 32 inhibit the shower curtain 16 from being blown into the shower stall 12 as commonly occurs as a result of the temperature imbalance caused by hot water in the shower stall 12. Thus, a person bathing in the shower stall 12 can enjoy bathing without being touched by the shower curtain 16. The mating units 42 are unmated from each other to facilitate the person bathing to exit the shower stall 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A curtain restraint assembly for inhibiting a shower curtain from being blown onto a person bathing in a shower, said assembly comprising:

a shower stall having a pair of opposing walls;

a shower curtain being suspended in an entry of said shower stall, said shower curtain extending between said pair of opposing walls when said shower curtain is in a closed position;

a pair of hooks, each of said hooks being attachable to a respective one of said opposing walls of said shower stall;

a pair of cords, each of said cords having a key ring which can be hooked on a respective one of said hooks for movably retaining said pair of cords on said respective hooks, each of pair of cords being positionable in a deployed position having said pair of cords extending across said shower curtain in linear alignment with each other thereby inhibiting said shower curtain from blowing into said shower stall wherein said pair of cords is configured to inhibit said shower curtain from touching a person bathing in said shower stall, each of said cords being positionable in a stored position having said cords hanging from said respective hook; and a pair of mating units, each of said mating units being attached to a respective one of said pair of cords, said pair of mating units being releasably matable to each other thereby facilitating said cords to attach each other in an end to end configuration for retaining said cords in said deployed position.

2. The assembly according to claim 1, wherein:

each of said hooks comprises a panel and a member curving upwardly from a front side of said panel such that a substantial length of said member is spaced from and is oriented parallel to said front side;

each of said hooks includes a mating element being applied to a back side of said panel thereby facilitating said mating element to engage said respective opposing wall for retaining said panel on said respective opposing wall; and said key ring on each of said cords extends through an outer wall of a respective cord at a point located adjacent to a first end of said respective cord thereby facilitating said ring on each of said cords to extend around said member associated with said respective hook for suspending said cords on said hooks.

3. The assembly according to claim 1, wherein:

each of said cords has a first end and a second end, each of said pair of cords being comprised of a flexible and fluid impermeable material thereby inhibiting said pair of cords from being affected by water; and each of said pair of mating units comprises a cup having a rear end and a front end, said rear end of each of said pair of cups being attached to said second end of a respective one of said cords, said front end of each of said cups being open.

4. The assembly according to claim 3, wherein each of said cups has an outside diameter being greater than a diameter of said respective cord such that an outer surface of each of said pair of cups is displaced outwardly from said outer wall of said respective cord.

5. The assembly according to claim 4, wherein each of said mating units includes a magnet being positioned within said cup, said magnet having a forward surface being aligned with said front end of said respective cup.

6. The assembly according to claim 5, wherein said forward surface of said magnet in said cup associated with each of said mating units is magnetically matable to each other thereby attaching said pair of cords together.

7. A curtain restraint assembly for inhibiting a shower curtain from being blown onto a person bathing in a shower, said assembly comprising:

a shower stall having a pair of opposing walls;

a shower curtain being suspended in an entry of said shower stall, said shower curtain extending between said pair of opposing walls when said shower curtain is in a closed position;

a pair of hooks, each of said hooks being attachable to a respective one of said opposing walls of said shower stall, each of said hooks comprising a panel and a member curving upwardly from a front side of said panel such that a substantial length of said member is spaced from and is oriented parallel to said front side, each of said hooks including a mating element being applied to a back side of said panel thereby facilitating said mating element to engage said respective opposing wall for retaining said panel on said respective opposing wall;

a pair of cords, each of said cords having a key ring which can be hooked on a respective one of said hooks for movably retaining said pair of cords on said respective hooks, each of pair of cords being positionable in a deployed position having said pair of cords extending across said shower curtain in linear alignment with each other thereby inhibiting said shower curtain from blowing into said shower stall wherein said pair of cords is configured to inhibit said shower curtain from touching a person bathing in said shower stall, each of said cords being positionable in a stored position having said cords hanging from said respective hook, each of said cords having a first end and a second end, said key ring on each of said cords extending through an outer wall of a respective cord at a point located adjacent to said first end of said respective cord thereby facilitating said ring on each of said cords to extend around said member associated with said respective hook for suspending said cords on said hooks, each of said pair of cords being comprised of a flexible and fluid impermeable material thereby inhibiting said pair of cords from being affected by water; and a pair of mating units, each of said mating units being attached to a respective one of said pair of cords, said pair of mating units being releasably matable to each other thereby facilitating said cords to attach each other in an end to end configuration for retaining said cords in said deployed position, each of said pair of mating units comprising:

a cup having a rear end and a front end, said rear end of each of said pair of cups being attached to said second end of a respective one of said cords, said front end of each of said cups being open, each of said cups having an outside diameter being greater than a diameter of said respective cord such that an outer surface of each of said pair of cups is displaced outwardly from said outer wall of said respective cord; and a magnet being positioned within said cup, said magnet having a forward surface being aligned with said front end of said respective cup, said forward surface of said magnet in said cup associated with each of said mating units being magnetically matable to each other thereby attaching said pair of cords together.

8. A method of inhibiting a shower curtain from blowing into a shower stall, said assembly comprising:

providing a shower stall having a pair of opposing walls and a shower curtain extending between said pair of opposing walls;

providing a pair of hooks;

providing a pair of cords;

providing a pair of rings each being attached to a respective one of said cords;

providing a pair of mating units each being attached to a respective one of said cords;

attaching each of said hooks to a respective one of said opposing walls of said shower;

hanging each of said rings on a respective one of said hooks; and extending each of said cords toward each other thereby facilitating said mating units to be mated to each other in an end to end configuration for retaining said cord in a deployed position extending across said shower curtain in linear alignment with each other thereby inhibiting said shower curtain from being blown into said shower stall.

* * * * *